United States Patent [19]

Skuran

[11] 4,100,711

[45] Jul. 18, 1978

[54] PREFABRICATED INSULATING PANEL

[75] Inventor: Victor Skuran, Chicago, Ill.

[73] Assignee: Transco Inc., Chicago, Ill.

[21] Appl. No.: 807,248

[22] Filed: Jun. 16, 1977

[51] Int. Cl.[2] ..... E04B 1/62; E04B 2/00

[52] U.S. Cl. ..... 52/489; 52/539; 52/588

[58] Field of Search ..... 52/489, 588, 520, 531, 52/539, 545, 546, 519, 542, 543, 478, 404

[56] References Cited

U.S. PATENT DOCUMENTS

| | | | |
|---|---|---|---|
| B 331,557 | 1/1975 | Vare | 52/489 |
| 1,913,342 | 6/1933 | Schaffert | 52/492 |
| 2,114,155 | 4/1938 | Streich | 52/588 |
| 2,150,997 | 3/1939 | Venzie | 52/588 |
| 2,857,995 | 10/1958 | Boulton | 52/520 |
| 3,205,631 | 9/1965 | Harris | 52/588 |
| 3,315,429 | 4/1967 | Swanson | 52/588 |
| 3,388,518 | 6/1968 | Scott | 52/520 |
| 3,394,519 | 7/1968 | Tischuk | 52/520 |

FOREIGN PATENT DOCUMENTS

| | | | |
|---|---|---|---|
| 729,339 | 3/1966 | Canada | 52/546 |

*Primary Examiner*—John E. Murtagh

[57] ABSTRACT

A prefabricated insulating panel and mounting assembly providing an outer metallic sheet together with an inner batt of insulation material carried thereon, with the outer metallic sheet providing a longitudinally extending clip to which is attached a hanger whereby the panel may be fixedly positioned upon a supporting structure to be insulated.

3 Claims, 3 Drawing Figures

PREFABRICATED INSULATING PANEL

SUMMARY OF THE INVENTION

It is an object of this invention to provide a prefabricated insulating panel and mounting assembly which is economical in manufacture and more readily adaptable for installation than previous heavier and bulkier insulated panels.

This new and novel panel comprises an outer metallic face sheet together with an inner batt of insulation material carried thereon. The face sheet provides a raised longitudinal top edge of double thickness which is adapted to mate with a seat provided by the corresponding bottom of the juxtapositioned insulating panel. The face sheet also provides a rearwardly extending covering flange that terminates into an open clip.

A hanger in the form of an angle bar provides a mounting plate and a horizontal base flange which terminates into a reverse opening slip, which is adapted to frictionally receive the clip provided by the covering flange, so as to frictionally join the parts into a complete assembly, which may then be readily mounted onto a supporting structure to be insulated.

The bottom horizontal edge of the face sheet is formed to provide a downwardly directed open seat for the reception therein of the raised top edge of a juxtapositioned panel, thus forming an effective moisture and dust-free seal between such panels as they are progressively mounted upon the support structure.

GENERAL DESCRIPTION

The invention will be best understood by reference to the accompanying drawings which show the preferred form of the invention by which the objects thereof are achieved, and in which.

Figure 1:
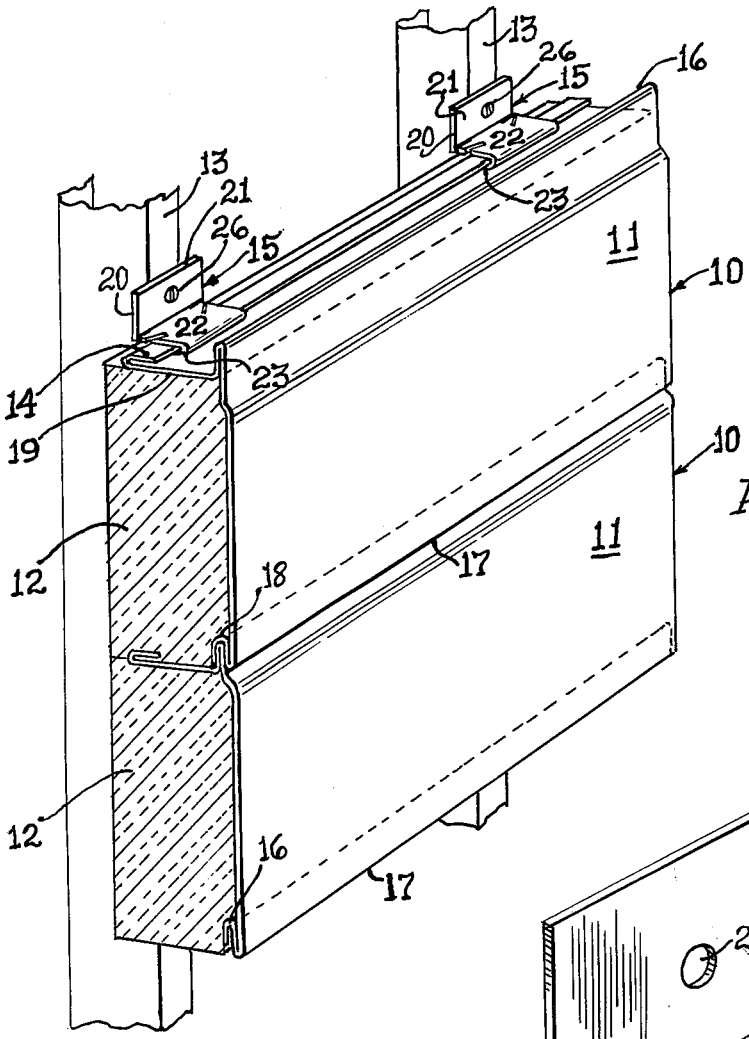
FIG. 1 is a fragmentary perspective view of a pair of juxtapositioned insulating panels of the invention.

Referring to the drawings in more detail, FIG. 1 discloses a pair of insulating panels 10 assembled in overlapping relation. As each of the panels is identical in construction, only one will be described in detail.

The insulating panel 10 of FIG. 1 includes an outer metallic sheet 11 which has mounted on the interior face thereof a batt of insulating material 12. This material may be mounted onto the outer face sheet 11 by suitable mounting means, such as those disclosed in U.S. Pat. No. 3,879,910, or it may be adhesively attached thereto without departing from the spirit of this invention.

There is also shown in FIG. 1 the method of mounting the panels 10 onto supports 13 which includes the components of a clip 14 and a hanger 15.

Figure 3:
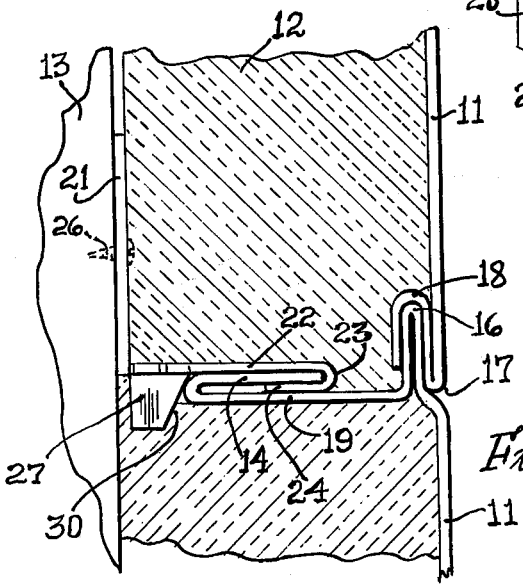
FIG. 3 is a fragmentary side elevational view of the hanger and a pair of juxtapositioned panels mounted relative thereto.

In greater detail, each of the panels 10 provides a raised top edge 16 which is formed by having the metallic sheet 11 reversely bent upon itself as shown. The bottom parallel horizontally extending edge 17 is reversely bent so as to reinforce such edge 17, and then formed to provide a bottom seat 18. As shown in FIGS. 1 and 3, the seat 18 is adapted to receive the raised top edge 16 of the juxtapositioned panels when the same are mounted upon the supports 13. Each of the panels 10 then provides a laterally extending covering flange 19 which extends from the inner face of the panel 10 in the direction of and over the top edge portion of the batt of insulating material 12 until it is reversely bent so as to provide the open clip 14.

The assembly includes a hanger 15 which is formed from an angle bar 20 and provides a vertically extending mounting plate 21 as well as a horizontally extending base plate 22. The forward edge 23 of the base plate 22 is dependently and reversely bent so as to form an open slip 24. The mounting plate 21 has formed therein an aperture 25 adapted to receive suitable fasteners 26 by which the hanger 15 is mounted upon the supports 13, as shown in FIGS. 1 and 3.

In assembling the insulating panels upon the support structure, the application of the panels 10 begins with the lowermost panel and progresses upwardly therefrom. As such, the lowermost panel is prefabricated and the hangers 15 positioned upon the clip 14 at any point throughout its longitudinal length so as to correspond to the spacing between the supports 13, as shown. When the panels are mounted, the top edge 16 of the lowermost panel is forcibly inserted into the seat 18 formed by the bottom edge of the next succeeding panel.

Figure 2:
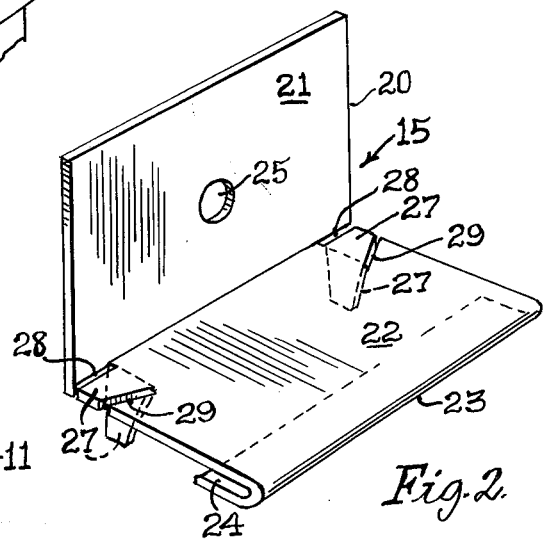
FIG. 2 is a perspective view of the hanger assembly of the invention.

To maintain the hanger assembly 15 upon the clip 14 of the panel 10, the horizontal base plate 22 may be provided with retaining ears 27. These ears 27 are formed by a suitable cut 28 formed at the fold line between the mounting plate 21 and the base plate 22 of the angle bar 20 of the hanger 15, as well as by a tapered cut 29 formed in the horizontal base plate 22, all of which is shown in FIG. 2.

The hanger 15 may be placed so that the clip 14 is received in the open slip 24, at which time the ears 27 may be bent in a downward direction to the rear of the innermost edge of the clip 14, as seen in FIG. 3. As the ears 27 are bent downwardly, the tapered cut 29 will provide a camming edge 30 which will bear against the inner edge of the clip 14 so as to secure the mating connection between the clip 14 and the slip 24 in a secured manner.

From the foregoing, it is apparent that there is provided an economical insulating panel together with an assembly whereby the same may be readily and conveniently mounted upon the supporting structure with the panels providing an overlapping edge connection which prevents the introduction of moisture, dirt, or dust between such panels when the same are mounted in juxtaposition. There is also provided by the mounting assembly a means for maintaining the mounting hanger 15 upon the panel 10 prior to its securement to the supports 13, as illustrated.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A prefabricated insulating panel assembly adapted to be mounted in interconnected relationship with other panels on a support member comprising (a) an outer metallic sheet carrying a batt of insulating material on its inner face, (b) a covering flange provided by one horizontal edge of said outer sheet and extending over a portion of the top edge of the insulating material carried thereby, (c) means provided by said one horizontal edge of said outer sheet extending perpendicularly with respect thereto for providing overlapping interconnection between corresponding means provided by a juxtapositioned panel adapted to be mounted upon the support member, (d) a clip formed along the inner edge of said covering flange and extending perpendicularly to and opening in the direction of said one horizontal edge of said sheet, (e) a hanger mounted on said clip and providing a vertical mounting plate extending parallel to said outer metallic sheet, (f) means on said hanger adapted to contact said clip so as to cam the same in the direction away from the support member when said clip is connected to said hanger and said panels are placed in interconnected juxtaposition upon the support member, and (g) a fastener adapted to be carried by said vertical mounting plate of said hanger securing the panels onto the support member.

2. A prefabricated insulating panel as defined by claim 1, wherein said hanger provides an open slip receiving therein said clip so as to connect the same together for mounting upon the support member.

3. A prefabricated insulating panel as defined by claim 2, wherein said means on said hanger adapted to contact said clip, comprise ears cut in opposite side edges of said clip and providing camming surfaces extending in diverging direction toward said one longitudinal edge, with said camming surfaces adapted to engage a portion of said clip when the same is inserted in said slip for forcing the same into said clip so as to secure said clip onto said hanger.

* * * * *